US007160196B2

(12) United States Patent
Thirkettle et al.

(10) Patent No.: US 7,160,196 B2
(45) Date of Patent: Jan. 9, 2007

(54) IDENTIFICATION DEVICE

(75) Inventors: John S. Thirkettle, Long Marston (GB); David V. Jolliffe, Watford (GB)

(73) Assignee: World Golf Systems Limited, Watford (GB)

( * ) Notice: Subject to any disclaimer, the term of this patent is extended or adjusted under 35 U.S.C. 154(b) by 0 days.

(21) Appl. No.: 10/480,867

(22) PCT Filed: Jun. 14, 2002

(86) PCT No.: PCT/GB02/02735

§ 371 (c)(1),
(2), (4) Date: Apr. 29, 2004

(87) PCT Pub. No.: WO02/102473

PCT Pub. Date: Dec. 27, 2002

(65) Prior Publication Data

US 2004/0176174 A1 Sep. 9, 2004

(30) Foreign Application Priority Data

Jun. 14, 2001 (GB) ..... 0114543.2

(51) Int. Cl.
*A63B 69/36* (2006.01)

(52) U.S. Cl. ..... 473/132; 473/151

(58) Field of Classification Search ..... 473/132–137, 473/150–155; 273/144 R, 144 A, 144 B, 273/138.2
See application file for complete search history.

(56) References Cited

U.S. PATENT DOCUMENTS 3,142,488 A * 7/1964 Portteus ..... 473/132
3,246,126 A * 4/1966 Gutman et al. ..... 235/458
3,458,204 A * 7/1969 Wilson ..... 473/134
3,740,922 A * 6/1973 Liou ..... 53/571
4,741,537 A * 5/1988 Adam ..... 473/135
5,167,301 A * 12/1992 Cappi et al. ..... 186/66
5,211,263 A * 5/1993 Davidson et al. ..... 186/61
5,370,389 A * 12/1994 Reising ..... 473/153
5,376,923 A * 12/1994 Kindschy ..... 335/284
5,383,668 A * 1/1995 Andrikian ..... 473/132
5,439,224 A * 8/1995 Bertoncino ..... 473/153
5,513,841 A 5/1996 Takagi
5,582,550 A * 12/1996 Foley ..... 473/153
5,641,039 A * 6/1997 Dumont ..... 186/61
5,646,389 A * 7/1997 Bravman et al. ..... 235/385
5,665,004 A * 9/1997 Vlahovic ..... 473/137
6,120,024 A 9/2000 Lind
6,129,242 A 10/2000 Chan
6,491,218 B1 * 12/2002 Nguyen ..... 235/383
6,607,123 B1 * 8/2003 Jollifee et al. ..... 235/375

(Continued)

FOREIGN PATENT DOCUMENTS

JP 11033156 8/2000

(Continued)

*Primary Examiner*—Steven Wong
(74) *Attorney, Agent, or Firm*—Sheridan Ross P.C.

(57) ABSTRACT

A tray (10) for supplying coded golf balls (50) to the tee (41) of a golf driving range comprises a first zone (11) for receiving golf balls, one of which is selected to be played by moving it by means of a club over a barrier (14) to a second (12) where it passes under gravity through an outlet (30) past a code reader (41) to the tee (41). An indicator light (46) is provided to confirm that the code has been read. The barrier (14) may have a grooved side (15) to assist transfer of the golf ball from the first zone (11) to the second zone (12).

20 Claims, 3 Drawing Sheets

U.S. PATENT DOCUMENTS 6,607,125 B1 * 8/2003 Clouser et al. ..... 235/383

FOREIGN PATENT DOCUMENTS

JP 11137758 10/2000

WO WO 99/48046 9/1999

WO WO 01/02060 1/2001

* cited by examiner

IDENTIFICATION DEVICE

The present invention relates to an identification device and in particular to a device for identifying rolling articles which are coded. The articles may be golf balls of the type disclosed in prior patent application PCT/GB00/02461 and the device may be installed in a golf driving range of the type disclosed in prior patent application PCT/GB99/00883. The golf balls preferably house coded r.f. identification tags or transponders and the identification device preferably comprises an antenna.

A problem with existing ball identification devices is that the relative orientation of the tag in the ball and the antenna in the identification device may be such that the tag and its code are not detected. Possible solutions involve causing the antenna to move, but this requires the additional complexity of moving parts, or alternatively causing the golf ball to move through a convoluted path, but this is again a complex arrangement, the balls are delayed in reaching their final destination and may even become jammed.

Another problem with existing ball identification devices is that the provision of communications and power connections thereto necessitate digging up the ground or providing under floor conduits.

U.S. Pat. No. 5,513,841 discloses a golf driving range having a device for automatically lifting coded golf balls from a ball storage tank arranged underneath the tees to a ball holder from which the balls move down a sloping ball guide passage past ball code reading means to the desired tee.

The present invention seeks to overcome or reduce one or more of the above problems.

According to a first aspect of the present invention, there is provided a device for identifying coded rolling articles comprising a first zone for holding a plurality of articles separated by a barrier from a second zone, the barrier being such that the articles can be rolled over the barrier individually, the second zone being configured such that an article therein is constrained to move to an outlet of the device past means for reading the code of the article, characterised in that the device is configured as a tray, the barrier dividing the tray into said first and second zones, which are both lower than the barrier, and in that a user can move a selected one of the articles from said first zone over the barrier to said second zone.

The articles in the second zone are preferably constrained to move to the outlet under the influence of gravity. The articles are preferably golf balls and the coding is preferably provided by r.f. tags. The barrier is preferably such that the golf balls can be moved over it by a golf club.

The first zone is preferably configured so that as articles are removed therefrom, the remaining articles are constrained e.g. by gravity, to move towards the barrier.

Indicating means, such as a light, may be provided adjacent to the outlet for indicating that the reading device has read the code of an article. The reading device is preferably an antenna arranged directly adjacent to the outlet, e.g. immediately below it.

According to a second aspect of the present invention, there is provided a method of placing golf balls on a tee of a golf driving range, comprising the steps of:

(i) placing a plurality of coded golf balls in a first zone of a ball tray;

(ii) moving a selected one of said golf balls by means of a golf club from said first zone over a barrier to a second zone of the ball tray;

(iii) constraining the selected golf ball to move towards and through an outlet of the tray;

(iv) reading the code of the selected golf ball as it moves through the outlet; and (v) passing the selected golf ball from said outlet to the tee.

A preferred embodiment of the present invention will now be described, by way of example only, with reference to the accompanying drawings, of which:

Figure 1:
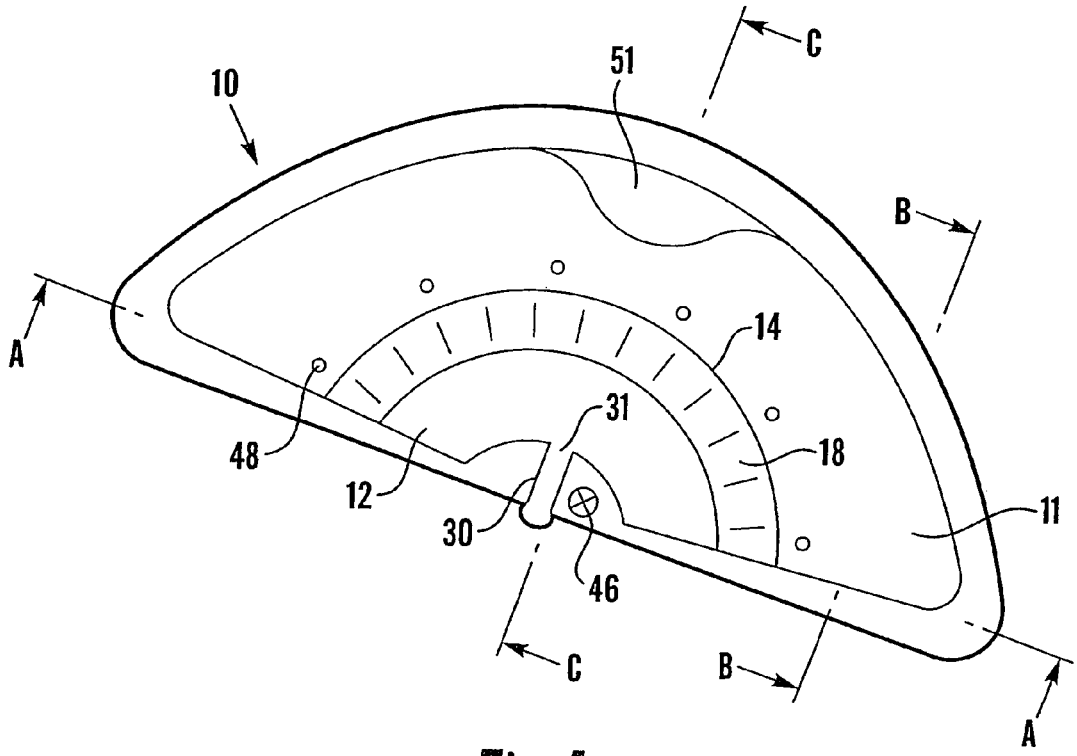
FIG. 1 is perspective view of a device in accordance with the present invention in the form of a golf ball tray.
Figure 2:
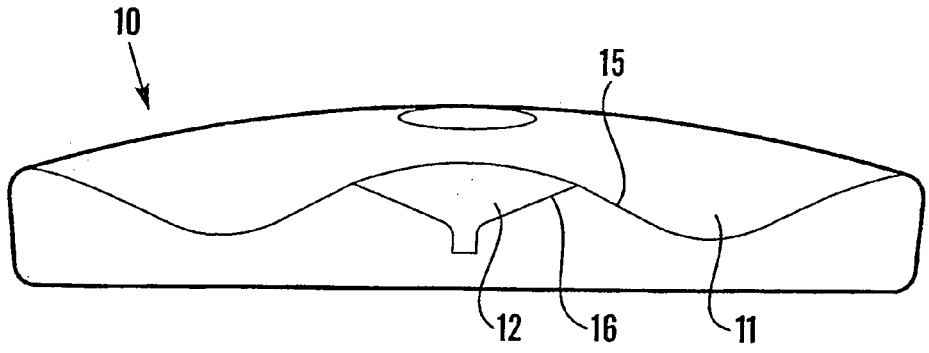
FIGS. 2, 3 and 4 are respective sectional views on the lines A—A, B—B and C—C of the tray of FIG. 1.
Figure 6:
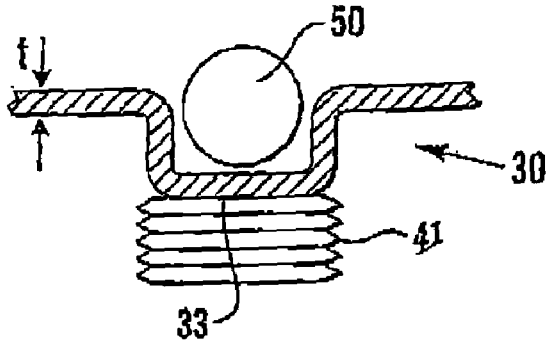
FIGS. 6 and 7 are end and side views of an outlet region of the tray of FIG. 1.
Figure 6A:
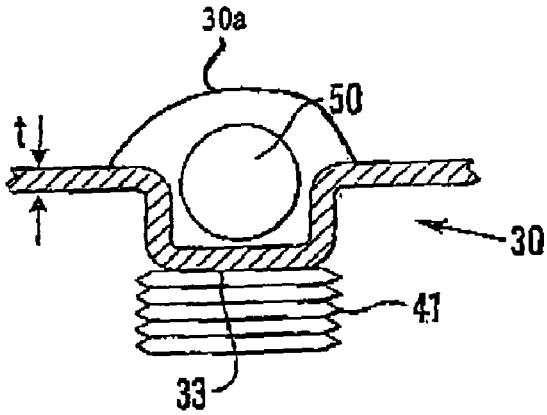
Figure 7:
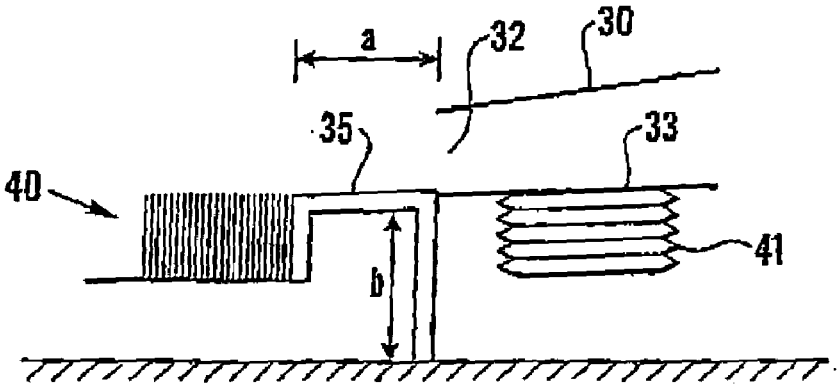

FIG. 6*a* is an alternative embodiment of the tray of FIG. 1.

Figure 3:
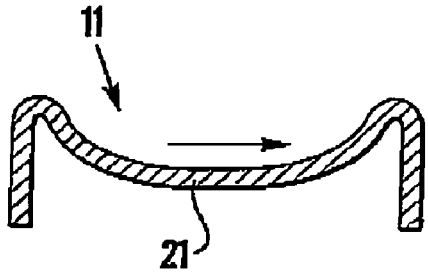
Figure 4:
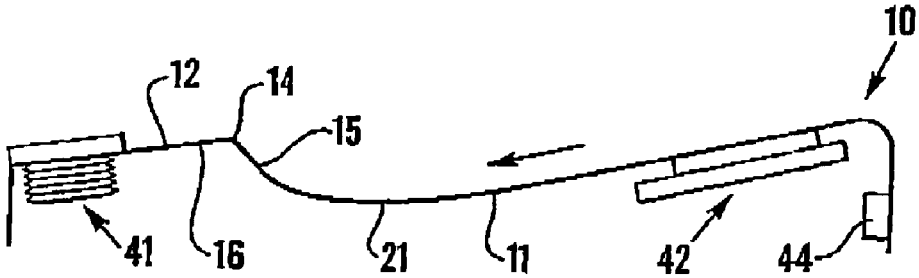
Figure 5:
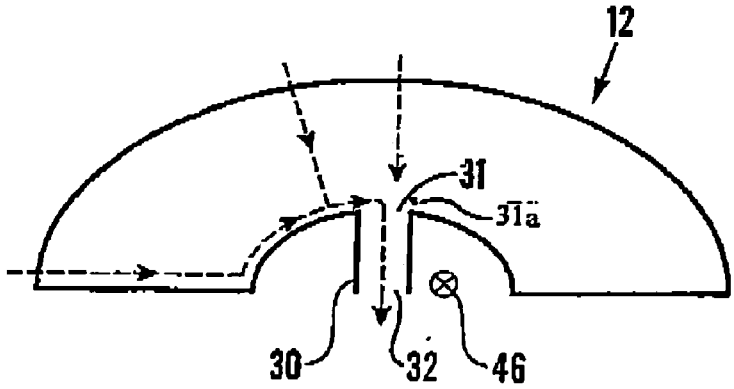
FIG. 5 is a schematic top plan view of an inner part of the tray of FIG. 1.

Referring now to the drawings, a generally semi-elliptical tray 10 of moulded plastics material comprises a relative large zone 11 of a generally crescent shape for holding up to sixty golf balls. As shown in FIGS. 3 and 4, the base 21 of zone 11 slopes towards the centre so that balls therein roll radially inwardly under the effect of gravity. Zone 11 includes a land 51 to receive an identification mark or logo. Zone 11 surrounds a central generally semi-circular zone 12 and the zones are separated by a barrier 14 which is shaped so as to resemble the walls of half a volcano. It will be noted that barrier 14 is sloped on both its outer and inner sides 15, 16 so that a player may readily move one of the golf balls from zone 11 to zone 12. The outer side 15 has grooves 18 to assist this process.

Zone 12 slopes towards one end 31 of a central outlet chute 30, which itself slopes, so that golf balls introduced into zone 12 automatically roll under the effect of gravity and through the chute and out of its other end 32 over a lip 35 on to a mat 40 which constitutes a golf driving tee of a golf driving range.

A cross-section through the chute is shown in FIG. 6, from which it can be seen that a detector antenna coil 41 is located directly underneath the bottom 33 of the chute 30. The coil is connected via leads (not shown) to a decoder unit 42 housed inside the interior of the tray moulding. The coil 41 and unit 42 are connected via further leads (not shown) to power and communications connectors 44. The communications connectors may be connected to a control device as disclosed in PCT/GB99/00883.

An indicator light 46 is located on the tray adjacent the outlet chute 30. The decoder unit causes the light to be illuminated for a limited period to indicate to a player that the code on a ball which has just passed through chute 30 has satisfactorily had its code read.

Typical dimensions of the tray are 110 cm along section AA and 30 cm along section CC. The thickness of the moulding ("t", see FIG. 6) is approximately 5 mm. Lip 35 extends for a distance "a" of approximately 25 mm and has a height "b" of approximately 50 mm. To remove any rainwater, drainage holes 48 are provided in the base 21 of zone 11.

In use, balls are placed into the large holding part 12 of the tray 10 and are pulled up one by one over the ramp lid of barrier 14 by use of a golf club. Once over the ramp lip, the ball 50 rolls down the ramp and through the exit channel formed by chute 30. The ball then leaves tray 10 and rolls onto the hitting area 40. As each ball passes through the exit channel 30 it passes over the powered antenna 41 in the registration zone. The antenna 41 senses the transponder or tag in the ball and feeds back information to the decoder unit 42. As each ball is detected, light 46 illuminates. If a ball is not detected it must be placed back for reading in the registration zone.

The above-described arrangement has numerous advantages. The antenna 41 is close to the moving ball and is small and compact. The antenna does not move, in fact there are no moving parts. Ball 50 travels solely under the forces of gravity. The antenna field is focused and thus the registration zone is more sensitive. The electronic circuitry is relatively simple and installation is also since all the components are above ground. The arrangement is flexible since it can be used on all surfaces indoors and out.

Since the ball 50 is rolling as it moves over antenna 41, there is only a low probability that its code will not be detected by the antenna at some stage of this movement. The moulding of tray 10 in one piece is a convenient process and the installation of the decoder unit 42 and the connectors 44 within the internal cavity of moulding produces a tidy arrangement and avoids the need for underground or under floor connections.

Numerous modifications may be made to the above-described tray. For example, to prevent balls 50 moving too quickly along chute 30 on or more obstacles 31*a* such as pips may be provided in zone 12 adjacent the entrance 31 of the chute. The pips serve to slow the ball down. The light 46 may be replaced or supplemented by visual indication at another location, e.g., on a display unit at eye level. There may also be provided means for detecting the passage of a ball, whether or not the ball is coded. This enables a positive visual warning to be given that a code has not been detected. In this case, an audible warning may alternatively or additionally be given to indicate that the code of a ball has not been read.

The chute 30 may be generally U-shaped so that it is open at the top or may be constituted by an enclosed tube 30*a* (see FIG. 6*a*). The tray 10 may have any other convenient shape and may be made from any suitable material.

Other ball-coding techniques may be used, such as optical coding. The golf balls can have bar codes which are read by an optical bar code reader in chute 30.

The tray can be used to detect the issue of other types of balls and spherical objects. Indeed the passage of any object which rolls, such as a cylindrical article, can be detected.

The invention claimed is:

1. A system for identifying coded rolling articles comprising a tee, a tray, a barrier, and means for reading the code of the articles, the tray having a first zone for holding a plurality of articles, and a second zone having an outlet, whereby the barrier separates the first zone of the tray from the second zone of the tray which are both lower than the barrier, the barrier being arranged such that the user can roll a selected individual article from the first zone up and over the barrier into said second zone of the tray which is configured such that an article is constrained to move to and through the outlet of the tray past the means for reading the code of the article so that the code of the article is read before the article exits the device, wherein said articles are golf balls and wherein golf balls pass from said outlet to the tee.

2. A system according to claim 1, wherein an article in the second zone is constrained to move under the influence of gravity through the outlet of the tray past the means for reading the code of the golf balls.

3. A system according to claim 1, wherein articles in the first zone are constrained to move towards the barrier.

4. A system according to claim 1, wherein indicating means are provided for indicating that the reading means has read the code of an article.

5. A system according to claim 4, wherein the indicating means are provided adjacent to said outlet.

6. A system according to claim 1, wherein each article is coded by means of an r.f. tag, and the reading means includes an antenna located adjacent to said outlet.

7. A system according to claim 6, wherein the antenna is connected to a decoder unit housed inside the tray.

8. A system according to claim 1, wherein said barrier has a side adjacent said first zone, and wherein said side has grooves.

9. A system according to claim 1, wherein one or more obstacles are provided adjacent the entrance of said outlet.

10. A method of placing golf balls on a tee of a golf driving range, comprising the steps of:

(i) placing a plurality of coded golf balls in a first zone of a ball tray;

(ii) moving a selected one of said golf balls by means of a golf club from said first zone over a barrier to a second zone of the ball tray;

(iii) constraining the selected golf ball to move towards and through an outlet of the tray;

(iv) reading the code of the selected golf ball as it moves through the outlet; and (v) passing the selected golf ball from said outlet to the tee.

11. A system according to claim 1 further comprising means for slowing the article as it moves through the outlet of the device.

12. A system according to claim 11, wherein the outlet comprises an enclosed tube.

13. A system according to claim 11 wherein the means for slowing the article comprises at least one obstacle adjacent the entrance of the outlet.

14. A system according to claim 1, wherein the barrier has a side adjacent the first zone and a side adjacent the second zone, both sides being sloped and wherein a user can move a selected one of the articles from said first zone over the barrier to said second zone by use of a golf club.

15. A system according to claim 14 wherein the tray is generally semi-elliptical in shape and comprises molded plastics material.

16. A system according to claim 14 wherein the barrier is shaped so as to resemble the walls of half a volcano.

17. A system according to claim 1 wherein the means for reading the code of the articles is located adjacent to the outlet.

18. A system according to claim 1 wherein the outlet comprises an exit channel and the means for reading the code of the articles is located adjacent to the exit channel.

19. A system according to claim 18 wherein the means for reading the code of the articles comprises a detector antenna located at the bottom of the exit channel.

20. A system according to claim 1 further comprising coded golf balls.

* * * * *